United States Patent [19]

Koshizuka et al.

[11] Patent Number: 4,954,390

[45] Date of Patent: Sep. 4, 1990

[54] THERMAL TRANSFER RECORDING MEDIUM

[75] Inventors: Kunihiro Koshizuka; Takao Abe, both of Hino, Japan

[73] Assignee: Konica Corporation, Tokyo, Japan

[21] Appl. No.: 252,877

[22] Filed: Oct. 3, 1988

[30] Foreign Application Priority Data

Oct. 13, 1987 [JP] Japan ..... 62-257886

[51] Int. Cl.[5] ..... B41M 5/26

[52] U.S. Cl. ..... 428/212; 428/195; 428/216; 428/421; 428/423.3; 428/423.5; 428/423.7; 428/424.2; 428/424.6; 428/425.1; 428/474.4; 428/475.2; 428/476.3; 428/476.9; 428/479.3; 428/480; 428/481; 428/483; 428/484; 428/488.1; 428/488.4; 428/492; 428/493; 428/494; 428/495; 428/496; 428/497; 428/498; 428/501

[58] Field of Search ..... 428/216, 914, 421, 474.4, 428/475.2, 476.3, 479.3, 476.9, 480, 481, 483, 425.1, 423.3, 501, 423.5, 508, 423.7, 515, 424.2, 520, 424.6, 532, 536, 492, 493, 494, 495, 496, 521, 519, 497, 498, 195, 488.1, 488.4, 484, 9 B, 212

[56] References Cited

U.S. PATENT DOCUMENTS 4,783,360 11/1988 Katayama et al. ..... 428/488.1

*Primary Examiner*—Pamela R. Schwartz

*Attorney, Agent, or Firm*—Frishauf, Holtz, Goodman & Woodward

[57] ABSTRACT

A thermal transfer recording medium is disclosed which is improved not only in the print quality on a transferee medium of poor smoothness, but also in character quality in a high speed printing operation. The recording medium comprises a support and at least two heat softening layers provided on the support in the order of a first heat softening layer and a second heat softening layer. At least one of said first and second heat softening layers contain a colorant, and said second heat softening layer contains a heat fusible substance in an amount of from 15% to 50% by weight; a thermo-plastic resin in an amount of from 20% to 80% by weight; and a tackifier in an amount of from 5% to 35% by weight.

20 Claims, No Drawings

THERMAL TRANSFER RECORDING MEDIUM

FIELD OF THE INVENTION

The present invention relates to a novel thermal transfer recording medium. More specifically, the invention relates to a thermal transfer recording medium capable of not only providing high print quality on a transferee medium of poor smoothness, but also providing high quality characters even in a high speed printing operation.

BACKGROUND OF THE INVENTION

The thermal transfer recording process is a technique that uses a thermal transfer recording medium such as a thermal transfer ink ribbon, comprising a support provided thereon a heat softening layer that is prepared by dispersing a colorant in a heat-fusible substance. The heat softening layer is placed on a transferee medium such as a paper and a thermal head applies heat onto the thermal transfer recording medium from the support side, in order to melt an area on the heat softening layer in the shape corresponding with the heated pattern; the fused portion of the layer is transferred onto the transferee medium.

A method using a thermal transfer recording medium has an unsolved problem; poor print quality with a transferee medium of poor smoothness, may be simply called "rough paper" hereinafter.

To solve this disadvantage, various measures have been so far proposed, and print quality attained at an ordinary print speed with a rough paper has reached acceptable level for ordinary application.

Recent thermal transfer recording systems are increasingly categorized into two groups: one intended for possible use of a transferee medium of poor smoothness, and being capable of forming high quality print on this type of medium; and the other that is capable of high speed printing with a transferee medium. Some of the similar recording systems are capable of both low speed printing and high speed printing by switching between different modes. The thermal transfer recording medium used on these systems is preferably not only capable of providing high quality print with a rough paper at an ordinary print speed, but also capable of achieving good printing performance at a high speed.

Characteristics required of a thermal transfer recording medium in improving high speed printing performance differ those required for improving printing performance with a rough paper. Correspondingly, the thermal transfer recording means for a rough paper does not incorporate consideration for high speed printing performance. Also, a presently available thermal transfer recording medium for high speed printing fail to attain high print quality if a rough paper is used. Simultaneously satisfying not only high speed printing performance but also that for rough paper requires high levels of properties of the thermal transfer recording medium, for example, rapid thermal response, good adhesion to a transferee medium, disruptiveness; and layer property suitable for preventing printing failures due to non-smooth surface of a transferee medium, as typified by void occurrence, and the like. A thermal transfer recording medium for high speed printing prone to develop voids on a rough paper; a thermal transfer recording medium for a rough paper lacks in properties including rapid thermal response property, and print quality resulting from rapid transferring is significantly poor.

In spite of high performance recording systems already developed, it is the reality that two types of thermal transfer recording media be prepared and selectively used depending on printing speed, type of a transferee medium, and the like.

SUMMARY OF THE INVENTION

Accordingly, it is an object of the present invention to provide a thermal transfer recording medium capable of not only forming high-quality characters onto a transferee medium of poor smoothness at a higher speed, but also forming high-quality characters even in a high speed printing operation.

The object above is achieved by a thermal transfer recording medium comprising a support having thereon at least two heat softening layers in the order of a first heat softening layer and a second heat softening layer, wherein at least one of the first and second heat softening layers contains a colorant, and said second heat softening layer contains a heat fusible substance in an amount of from 15% to 50% by weight; a thermo-plastic resin in an amount of from 20% to 80% by weight; and a tackifier in an amount of from 50% to 35% by weight.

DETAILED DESCRIPTION OF THE INVENTION

A thermal transfer recording medium of the invention comprises a support provided thereon at least two heat softening layers, i.e. a first heat softening layer and a second heat softening layer. The first and second heat softening layers are formed on the support in this order; usually, the first heat softening layer is formed directly on the support, and upon the first heat softening layer is directly formed the second heat softening layer.

In the thermal transfer recording medium of the invention, the first heat softening layer may be formed on the support via another layer such as an adhesive layer or stripping layer, and, additionally, on the first heat softening layer may be formed the second heat softening layer via an intermediate layer or the like. Upon the second heat softening layer may be formed a protective layer.

A preferred support incorporated into a thermal transfer transfer recording medium of the invention is a heat-resistant support of high dimensional stability, and high smoothness.

The examples of a material for forming the support include paper such as normal paper, condenser paper, and laminated or coated paper; a resin film made such as of polyethylene, polyethylene terephthalate, polystyrene, polypropylene and polyimide, a combination of paper and resin film; and a metal sheet of aluminum foil, etc. Specifically as the support of the present invention, it is preferable to select one from the resin films, a combination of paper and resin film, or the metal sheet each having a smooth surface and allowing the first heat softening layer to be stripped from the support. The especially preferable is a resin film made of a material having good heat conductivity and heat-resistance, such as polyethylene terephthalate.

The thickness of the support is usually not more than 60 $\mu$m in order to obtain good heat conductivity. The particularly preferred thickness is within a range of 1.5 to 15 $\mu$m. To control adhesion of the support to a heat softening layer and the like, the surface of the support may be subjected to surface treatment such as corona discharge process, glow discharge process, and other electrical impact technique; or to flame treatment, ultraviolet irradiation, acidification, and saponification; or subbing process.

The support can have a backing layer on the other surface thereof.

A thermal transfer recording medium of the invention has a heat softening layer formed on the above support.

The heat softening layer usually contains a colorant, heat-fusible substance, and thermoplastic resin, and once heated to become fused or softened, parts of the layer are transferred onto a transferee medium to form transfer members such as printed characters.

In the thermal transfer recording medium of the invention, the heat softening layer comprises at least two layers, i.e. a first heat softening layer and a second heat softening layer.

The thermal transfer recording medium of the invention preferably contains a colorant in either the first or second heat softening layer. Usually, the medium contains a colorant in both layers.

The examples of the colorant that can be incorporated into the thermal transfer recording medium of the invention include conventional inorganic or organic pigments, and dyes.

The examples of the inorganic pigment include titanium dioxide, Carbon Black, zinc oxide, Prussian Blue, cadmium sulfide, and iron oxide; chromates of lead, zinc, barium, and calcium. The examples of the organic pigment include azo, thioindigo, anthraquinone, anthoanthrone, and triphendioxazine, vat dye pigments, and phthalocyanine pigments, metal (ex. copper) phthalocyanine and its derivative, and quinacridone pigment.

The examples of the organic dye include acid dyes, direct dyes, disperse dyes, oil soluble dyes, and metal complex oil soluble dyes.

The content ratio of the colorant per total amount of constituents in the heat softening layer is usually within a range of 5 to 30 wt. %.

The first heat softening layer usually contains heat-fusible substance and thermoplastic resin. The layer may further contain a colorant.

The typical examples of the heat-fusible substance constituting the first heat softening layer are as follows:

vegetable waxes such as carnauba wax, Japan wax, auriculae wax, and esparto wax;

animal waxes such as beeswax, insect wax, shellac wax, and spermaceti wax;

petroleum waxes such as paraffin wax, microcrystaline wax, polyethylene wax, ester wax, and acid wax;

mineral waxes such as montan wax, ozokerite, and cerecine;

higher fatty acids such as palmitic acid, stearic acid, margaric acid, and behenic acid;

higher alcohols such as palmityl alcohol, stearyl alcohol, behenyl alcohol, marganyl alcohol, myricyl alcohol, and eicosanol;

higher fatty acid esters such as cetyl palmitate, myricyl palmitate, cetyl stearate, and myricyl stearate;

amides such as acetamide, propionic amide, amide palmitic amide, stearic amide, and amide wax;

higher amines such as stearyl amine, behenyl amine, and palmityl amine.

These materials can be used singly or in combination.

The typical examples of the thermoplastic resin are used in the invention are as follows:

resins such as ethylene copolymers, polyamide resins, polyester resins, polyurethane resins, polyolefin resins, acrylic resins, vinyl chloride resins, cellulose resins, and ionomer resins;

elastomers such as diene copolymers, natural rubber, styrene-butadiene rubber, isoprene rubber, and chloroprene rubber;

high molecular compounds having a melting point of 50° to 150° C., such as phenol resins, cyclopentadiene resins, and aromatic hydrocarbon resins.

When using a thermoplastic resin, those especially advantageous among the above examples are acrylic resins, diene copolymers, and ethylene copolymers. Using an ethylene copolymer such as ethylene-vinyl acetate copolymer provides a thermal transfer recording medium that excels especially in high speed print quality.

The preferred thermoplastic resins are hereunder described.

The examples of the acrylic resin include an acrylic resin obtained by polymerizing a monobasic carboxylic acid such as (meth)acrylic acid or ester thereof with at least one compound being capable of copolymerizing with the former.

The examples of the carboxylic acid or ester thereof, each useful for this purpose, include (meth)acrylic acid, methyl (meth)acrylate, ethyl (meth)acrylate, isopropyl (meth)acrylate, butyl (meth)acrylate, isobutyl (meth)acrylate, amyl (meth)acrylate, hexyl (meth)acrylate, octyl (meth)acrylate, 2-ethylhexyl (meth)acrylate, decyl (meth)acrylate, dodecyl (meth)acrylate, hydroxyethyl (meth)acrylate, and hydroxyethyl (meth)acrylate. The examples of the above-mentioned copolymerizable compound include vinyl acetate, vinyl chloride, vinylidene chloride, maleic anhydride, fumaric anhydride, styrene, 2-methylstyrene, chlorostyrene, acrylonitrile, vinyltoluene, N-methylol (meth)acrylamide, N-butoxymethyl (meth)acrylamide, vinylpyridine, and N-vinylpyrrolidone; these examples can be used singly or in combination.

The examples of the diene copolymer include butadiene-styrene copolymers, butadiene-styrene-vinylpyridine copolymers, butadiene-acrylonitrile copolymers, chloroprene-styrene copolymers, and chloroprene-acrylonitrile copolymers.

The examples of the ethylene copolymer include ethylene-vinyl acetate copolymers, ethylene-ethyl acrylate copolymers, ethylene-methyl methacrylate copolymers, ethylene-isobutyl acrylate copolymers, ethylene-acrylic acid copolymers, ethylene-vinyl alcohol copolymers, ethylene-vinyl chloride copolymers, and ethylene-acrylic acid metal-salt copolymers.

Among these examples, the preferred thermoplastic resins for forming the first heat softening layer are ethylene based copolymers such as ethylene-vinyl acetate copolymer.

The first heat softening layer is a layer that controls behavior of the whole heat softening layer when the latter layer is stripped from the support in the course of transferring. Accordingly, the first heat softening layer preferably contains a higher rate of a heat-fusible substance so that whole the heat softening layer is readily fused or softened by heat exerted from the thermal head, and so that whole the layer is readily stripped from the support. Usually, a content of a heat-fusible substance in the first heat softening layer is not less than 50 wt. %. When the content exceeds 60 wt. %, whole the layer is more readily stripped from the support, and results in improved high speed transferablity.

The content of a thermoplastic resin in the first heat softening layer is usually not more than 50 wt. %. When the content is not more than 30 wt. %, in particular, not more than 15 wt. %, the adhesion of the first heat softening layer is not excessively high, thereby print quality is better even in a high speed printing operation.

The thickness of the first heat softening layer is arbitrarily determined based on the types of heat-fusible substance and thermoplastic resin used. From the view point of high speed printing performance, the preferred thickness is larger than the thickness of the second heat softening layer described later.

The first heat softening layer can be formed by a known method such as solvent coating process, hot-melt coating process, and water base coating process. However, according to the invention, forming this layer with the water base coating process can improve both high speed printing performance, and print quality of a rough paper. The first heat softening layer formed by aqueous emulsion coating process results in sharpness of printed characters, when compared with the similar layer formed by hot-melt coating process; the possible reason is high-speed disruptiveness of a layer formed.

An aqueous suspension used in water based coating process can be prepared by independently dispersing each component in water according to a known method, and mixing the respective dispersions together; or, otherwise, by mixing the respective components and dispersing the mixture in water.

The first heat softening layer can be formed by applying an aqueous suspension to and dry on a support according to a conventional method. The temperature for drying is preferably set below the melting point of a heat-fusible substance used.

The second heat softening layer contains a specific amount of a heat-fusible substance, specific amount of a thermoplastic resin, and specific amount of tackifier. This layer can contain a colorant. The second heat softening layer is mandatory indespensablly formed by an aqueous emulsion containing the above components.

A high speed printing operation requires that an intended portion on the heat softening layer is rapidly melted, and the portion in the fused state alone is rapidly transferred onto the transferee medium, and that this portion is firmly deposited on the transferee medium. The printing performance with a rough paper is improved when a coat, that is derived from portions of the heat softening layer that adhere onto the raised portions of the transferee medium, covers and firmly adheres to the recessed portions of the transferee medium.

In the heat softening layer of a thermal transfer recording medium for a high speed printing operation, where the layer is formed by a conventional solvent coating process, hot-melt coating process of the like, the aggregation force of a fused portion on the heat softening layer serves as a disruptive force with which the portion is stripped from the heated area. Accordingly, the heat softening layer itself must have a significantly large aggregation force. Correspondingly, when used a rough paper as a transferee medium, the aggregation force is responsible for void occurrence.

Based on the fact that reducing the disruptive force can reduce the aggregation force of a fused portion on the heat softening layer, the second heat softening layer is formed as a layer comprising an aqueous suspension where the particles constituting the aqueous suspension are left unmodified, and, accordingly, the laminar areas among individual particles act as fracture zones thereby the disruptive force of the second is positively reduced.

Using a tackifier promotes adhesion of the fused portion onto a transferee medium, and, correspondingly, not only fixation in the course of high speed printing operation but also fixation of members to be transferred such as printed characters, onto a rough paper are improved.

The heat-fusible substances possibly incorporated into the second heat softening layer are those previously exemplified in conjunction with the first layer.

The thermoplastic resins similarly incorporated into the second layer are those previously exemplified in conjunction with the first layer. Among those example thermoplastic resins, the preferable are singly used acrylic resin; and combinedly used acrylic resin and ethylene resin.

The tackifiers used in the invention are hydrocarbon compounds independently having a polar groups such as a hydroxide group, and carboxyl group. The tackifier is a substance that exhibits tackiness when used either singly or in conjunction with another component.

The examples of the tackifier include unmodified or modified rosin such as rosins, hydrogenated rosins, rosin maleic resins, polymerized rosin, and rosin phenol resins; terpene resins; and petroleum resins having as a parent nucleus containing 5 to 9 carbon atoms.

The second heat softening layer is a layer formed with an aqueous suspension, and whose heat-fusible substance content is within a range of 15 to 50 wt. %; thermoplastic resin content, within a range of 20 to 80 wt. %; and tackifier content, within a range of 5 to 35 wt. %. The above three contents simultaneously satisfying these ratios can improve both high speed printing performance and printing performance with a rough paper. The especially preferable second heat softening layer is a layer formed with an aqueous suspension whose heat-fusible substance content is within a range of 20 to 50 wt. %; thermoplastic resin content, within a range of 30 to 60 wt. %; and tackifier content, within a range of 10 to 30 wt. %.

The blending ratios of two of these components in the second heat softening layer are preferably within the following ranges: the content ratio between the heat-fusible substance and the thermoplastic resin is within a range of 70:30 to 5:95, particular, 65:35 to 20:80; the content ratio between the heat-fusible substance and the tackifier, 90:10 to 40:60, in particular, 85:15 to 45:55; the content ratio between the thermoplastic resin and the tackifier, 95:5 to 60:40, in particular, 90:10 to 65:35. These ratios when satisfied enable the properties of each component to be positively demonstrated, thereby adhesion of the members to be transferred such as printed characters is improved; and, at the same time, properties such as layer properties of the members transferred onto a rough paper are significantly improved. Accordingly, both high speed print quality as well as print quality with a rough paper simultaneously are improved.

The second heat softening layer is formed by the water based coating process.

An aqueous suspension used in water based coating process can be prepared by independently dispersing each weighed component in water according to a known method, and mixing the respective dispersions together; or, otherwise, by mixing the respective weighed components and dispersing the mixture in water.

The second heat softening layer can be formed by applying an aqueous suspension to and dry on the first heat softening layer according to a conventional method.

There is no specific limitation on a method for subjecting the aqueous suspension to coating. A known coating method such as that using a wire-bar can be used for this purpose.

The preferred coating thickness of the aqueous suspension i.e. the thickness of the second heat softening layer is, in terms of a dry thickness, is from 0.3 μm to 2.5 μm. The similar layer thicker than this level may deteriorate high speed printing performance in particular. According to the invention, the layer thickness of not more than 2.0 μm significantly improves high speed printing performance in particular.

To attain both good high-speed printing performance and affinity with a rough paper, the preferred total thickness of heat softening layer e.i. total thickness of the first and second heat softening layers, in the thermal transfer recording medium of the invention is from 1.0 μm to 5.5 μm. Accordingly, making the thickness of the second heat softening layer smaller than that of the first heat softening layer particularly improves the high speed printing performance; and, in spite of such an arrangement, the print quality with a rough paper does not deteriorate.

An aqueous suspension used for preparing the first and second heat softening layers may incorporate a surfactant. The useful surfactants can be conventional ones. However, those preferably used are fluorinated surfactants. Adding a fluorinated surfactant positively decreases the surface tension of the aqueous suspension, thereby the possible "repellency spot" can be positively eliminated; additionally, the possible blocking phenomenon on the second heat softening layer can be positively eliminated. The content of the fluorine surfactant is usually within a range of 0.05 to 3 wt. %, preferably 0.1 to 2 wt. % per total solid content in a heat softening layer to which the agent is added.

Ordinary fluorine surfactants serve this purpose. The examples of the fluorinated surfactant advantageously used in embodying the invention are as follows:

$$C_nF_{2n+1}SO_3M \qquad \text{Formula [1]}$$

$$C_nF_{2n+1}SO_2\underset{\underset{R^1}{|}}{N}(CH_2CH_2O)_mH \qquad \text{Formula [2]}$$

$$C_nF_{2n+1}SO_2\underset{\underset{R^1}{|}}{N}-Z-OSO_3M \qquad \text{Formula [3]}$$

$$C_nF_{2n+1}SO_2\underset{\underset{R^1}{|}}{N}-Z-COOM \qquad \text{Formula [4]}$$

In the above formulas [1] through [4], M represents an alkali metal atom or ammonium group; $R^1$ represents a hydrogen atom, or an alkyl group having 1 to 20 carbon atoms; both $R^2$ and $R^3$ represent alkyl groups having 1 to 20 carbon atoms, where both alkyl groups may be identical or different with each other; Z represents a divalent bonding group, and the preferred examples of which are an alkylene group, and arylalkylene group; X represents an anion residue; n is an integer, 3 to 20; m is an integer, 2 to 20.

Among these, the particularly preferred are the compound represented by formula either [1] or [3].

The especially preferred example compounds used in the invention as a fluorinated surfactant are as follows: (M represents K, Na, Li, or $NH_4$)

| |
|---|
| $C_6F_{13}SO_3NH_4$ |
| $C_8F_{17}SO_2N(CH_2CH_2O)_{11}H$ |
| $C_8F_{17}SO_2N(C_2H_5)(CH_2CH_2O)_{14}H$ |
| $C_8F_{17}SO_2N(CH_3)\ (CH_2CH_2O)_{16}H$ |
| $C_8F_{17}SO_2NHCH_2CH_2OSO_3Na$ |
| $C_8F_{17}SO_2N(C_2H_5)CH_2CH_2OSO_3Na$ |
| $C_8F_{17}SO_2N(CH_3)(CH_2CH_2O)_5SO_3K$ |
| $C_8F_{17}SO_2NH_2C_2COONa$ |
| $C_8F_{17}SO_2N(C_2H_5)CH_2COOK$ |
| $C_8F_{17}SO_2N(C_4H_9)CH_2CH_2COOK$ |

The aqueous suspension used in the invention can further contain a supercooling substance such as polyoxyethylene derivative, thickener such as sodium polyacrylate, e.g. sodium polyacrylate; and water soluble polymers such as polyvinyl pyrolidone, polyvinyl alcohol, water-soluble polyurethane, water-soluble acryl, water-soluble polyester, and water-soluble polyamide; and substance that improves the surface slidability of the heat softening substance, e.g. colloidal silica.

The thermal transfer recording medium of the present invention has a laminated heat softening layer, wherein a second heat softening layer is a layer formed using an aqueous suspension containing specific amounts of a heat-fusible substance, thermoplastic substance and tackifier. Thus the second heat softening layer is as one entity a uniform layer, while from the microscopic viewpoint, this layer is a continuous body comprising particles of a heat-fusible substance, thermoplastic resin, tackifier, and the like. The second heat softening layer formed as the continuous body of particles allow, in the course of transferring operation, the boundary between individual particles to be disrupted in a fracturing manner, thereby in a high speed transferring operation, a portion in the fused state is more readily stripped from the remaining portion in the non-fused state on the heat softening layer. Additionally, the first heat softening layer serves as a stripping layer, significantly enhancing the high-speed heat responsibility of the thermal transfer recording medium. Furthermore, the tackifier in the second heat softening layer, once transferred onto a transferee medium, exhibits strong adhesion to the transferee medium, thereby even in a high speed printing operation of 100 to 200 cps, significantly good print quality can be attained.

Such good high speed transferring performance is further improved by determining the thicknesses of the first and second heat softening layers within the preferred ranges according to the invention.

The thermal transfer recording medium of the invention, unlike conventional thermal transfer recording media for high speed transferring operation, does not require, for improved print quality in high speed transferring operation, excessively high cohesive force on a heat softening layer. In other words, as mentioned above, the second heat softening layer is a layer formed with an aqueous suspension, and, the heat softening layer once in the fused state can be readily stripped off the support, thereby sacrificing print performance on a rough paper is not necessary for improving high speed transferring performance. Accordingly, the composition of the second heat softening layer can be determined so that the layer can have appropriate cohesive force and appropriate maximum elongation. According to the invention, the high speed transferring performance is essentially determined based on the statuses of the heat softening layers rather than on the compositions of the same layers, and the composition of the second heat softening layer can be designed to have layer properties appropriate for a printing operation with a rough paper on which good print quality otherwise often fails to be attained at an ordinary printing speed (ex. 50 cps). To sum up, the thermal transfer recording medium of the invention is capable of attaining extremely high print quality with a rough paper at an ordinary printing speed.

In essence, the thermal transfer recording medium of the invention is capable of attaining high print quality even with a transferee medium of poor smoothness not only at an ordinary printing speed but also at a high printing speed. The thermal transfer recording medium of the invention is, as can be expected, capable of attaining high print quality with a transferee medium of high smoothness and an ordinary transferee medium at an ordinary printing speed, and, further, the thermal transfer recording medium of the invention is capable of attaining high print quality even with a rough paper in a high speed transferring operation.

To sum up, the thermal transfer recording media of the invention is always capable of providing high print quality without time-consuming procedures such as replacement of thermal transfer recording media in order to cope with different printing conditions or with a print speed of a thermal transfer recording apparatus or the like.

EXAMPLES

The term "part" in the following examples of the invention and in comparative examples means "part by weight".

EXAMPLE 1

Onto a 3.5 μm thick polyethylene terephthalate film, serving as a support, was applied aqueous suspension (A) specified below for forming the first heat softening layer by water based coating process with a wire-bar so that the dry thickness was 1.5 μm, and drying was performed by heating at 110° C., thus the first heat softening layer was formed.

| Aqueous suspension (A) for first heat softening layer (solid converted amount, hereunder applicable) | |
|---|---|
| Aqueous paraffin wax emulsion | 75 parts |
| Aqueous ethylene-vinyl acetate copolymer emulsion | 10 parts |
| Aqueous Carbon Black dispersion | 15 parts |

Next, onto the first heat softening layer was applied aqueous suspension (I), whose composition specified below, for forming the second heat softening layer by using a wire-bar so that the dry thickness was 1.5 μm, and drying was performed by heating at 110° C., so as to form the second heat softening layer, thus a thermal transfer recording medium of the invention was obtained.

| Aqueous suspension (I) for second heat softening layer | |
|---|---|
| Aqueous paraffin wax emulsion | 20 parts |
| Aqueous rosin emulsion | 10 parts |
| Aqueous acrylic resin emulsion | 40 parts |
| Aqueous ethylene-vinyl acetate copolymer emulsion | 15 parts |

-continued

| Aqueous suspension (I) for second heat softening layer | |
|---|---|
| Aqueous Carbon Black dispersion | 14 parts |
| Fluorinated surfactant | 1 part |

EXAMPLE 2

A thermal transfer recording medium of the invention was prepared in a manner same as that of Example 1, except that aqueous suspension (I) for forming the second heat softening layer was replaced with aqueous suspension (II), whose composition specified below, for forming the second heat softening layer.

| Aqueous suspension (II) for second heat softening layer | |
|---|---|
| Aqueous paraffin wax emulsion | 30 parts |
| Aqueous rosin emulsion | 10 parts |
| Aqueous acrylic resin emulsion | 30 parts |
| Aqueous ethylene-vinyl acetate copolymer emulsion | 15 parts |
| Aqueous Carbon Black dispersion | 14 parts |
| Fluorinated surfactant | 1 part |

EXAMPLE 3

A thermal transfer recording medium of the invention was prepared in a manner same as that of Example 1, except that aqueous suspension (I) for forming the second heat softening layer was replaced with aqueous suspension (III), whose composition specified below, for forming the second heat softening layer.

| Aqueous suspension (III) for second heat softening layer | |
|---|---|
| Aqueous paraffin wax emulsion | 48 parts |
| Aqueous rosin emulsion | 10 parts |
| Aqueous acrylic resin emulsion | 12 parts |
| Aqueous ethylene-vinyl acetate copolymer emulsion | 15 parts |
| Aqueous Carbon Black dispersion | 14 parts |
| Fluorinated surfactant | 1 part |

EXAMPLE 4

A thermal transfer recording medium of the invention was prepared in a manner same as that of Example 1, except that aqueous suspension (I) for forming the second heat softening layer was replaced with aqueous suspension (IV), whose composition specified below, for forming the second heat softening layer.

| Aqeuous suspension (IV) for second heat softening layer | |
|---|---|
| Aqueous paraffin wax emulsion | 20 parts |
| Aqueous rosin emulsion | 20 parts |
| Aqueous acrylic resin emulsion | 30 parts |
| Aqueous ethylene-vinyl acetate copolymer emulsion | 15 parts |
| Aqueous Carbon Black dispersion | 14 parts |
| Fluorinated surfactant | 1 part |

EXAMPLE 5

A thermal transfer recording medium of the invention was prepared in a manner same as that of Example 1, except that aqueous suspension (I) for forming the second heat softening layer was replaced with aqueous suspension (V), whose composition specified below, for forming the second heat softening layer.

| Aqueous suspension (V) for second heat softening layer | |
|---|---|
| Aqueous paraffin wax emulsion | 20 parts |
| Aqueous rosin emulsion | 34 parts |
| Aqueous acrylic resin emulsion | 16 parts |
| Aqueous ethylene-vinyl acetate copolymer emulsion | 15 parts |
| Aqueous Carbon Black dispersion | 14 parts |
| Fluorinated surfactant | 1 part |

EXAMPLE 6

A thermal transfer recording medium of the invention was prepared in a manner same as that of Example 1, except that aqueous suspension (I) for forming the second heat softening layer was replaced with aqueous suspension (VI), whose composition specified below, for forming the second heat softening layer.

| Aqueous suspension (VI) for second heat softening layer | |
|---|---|
| Aqueous paraffin wax emulsion | 20 parts |
| Aqueous terpene emulsion | 10 parts |
| Aqueous acrylic resin emulsion | 40 parts |
| Aqueous ethylene-vinyl acetate copolymer emulsion | 15 parts |
| Aqueous Carbon Black dispersion | 14 parts |
| Fluorinated surfactant | 1 part |

EXAMPLE 7

A thermal transfer recording medium of the invention was prepared in a manner same as that of Example 1, except that aqueous suspension (I) for forming the second heat softening layer was replaced with aqueous suspension (VII), whose composition specified below, for forming the second heat softening layer.

| Aqueous suspension (VII) for second heat softening layer | |
|---|---|
| Aqueous carnauba wax emulsion | 20 parts |
| Aqueous rosin emulsion | 10 parts |
| Aqueous acrylic resin emulsion | 40 parts |
| Aqueous ethylene-vinyl acetate copolymer emulsion | 15 parts |
| Aqueous Carbon Black dispersion | 14 parts |
| Fluorinated surfactant | 1 part |

EXAMPLE 8

A thermal transfer recording medium of the invention was prepared in a manner same as that of Example 1, except that aqueous suspension (I) for forming the second heat softening layer was replaced with aqueous suspension (VIII), whose composition specified below, for forming the second heat softening layer.

| Aqueous suspension (VIII) for second heat softening layer | |
|---|---|
| Aqueous paraffin wax emulsion | 20 parts |
| Aqueous rosin emulsion | 10 parts |
| Aqueous ethylene-vinyl acetate copolymer emulsion | 55 parts |
| Aqueous Carbon Black dispersion | 14 parts |
| Fluorinated surfactant | 1 part |

EXAMPLE 9

A thermal transfer recording medium of the invention was prepared in a manner same as that of Example 1, except that aqueous suspension (I) for forming the second heat softening layer was replaced with aqueous suspension (IX), whose composition specified below, for forming the second heat softening layer.

| Aqueous suspension (IX) for second heat softening layer | |
|---|---|
| Aqueous paraffin wax emulsion | 20 parts |
| Aqueous petroleum resin emulsion | 10 parts |
| Aqueous acrylic resin emulsion | 40 parts |
| Aqueous ethylene-vinyl acetate copolymer emulsion | 15 parts |
| Aqueous Carbon Black dispersion | 14 parts |
| Fluorinated surfactant | 1 part |

EXAMPLE 11

A thermal transfer recording medium was prepared in a manner identical with that of Example 1, except that the dry thickness of the second heat softening layer was changed to 2.4 μm.

EXAMPLE 11

A thermal transfer recording medium was prepared in a manner identical with that of Example 1, except that the dry thickness of the second heat softening layer was changed to 1.9 μm.

EXAMPLE 12

A thermal transfer recording medium was prepared in a manner identical with that of Example 1, except that the dry thickness of the second heat softening layer was changed to 3.0 μm.

EXAMPLE 13

A thermal transfer recording medium was prepared in a manner identical with that of Example 1, except that the dry thickness of the first heat softening layer was changed to 3.0 μm.

EXAMPLE 14

A thermal transfer recording medium was prepared in a manner identical with that of Example 1, except that the dry thickness of the first heat softening layer was changed to 4.0 μm.

COMPARATIVE EXAMPLE 1

A thermal transfer recording medium was prepared in a manner identical with that of Example 1, except that aqueous suspension (I) for forming the second heat softening layer was replaced with aqueous suspension (C-1) whose composition specified below for forming the second heat softening layer.

| Aqueous suspension (C-1) for second heat softening layer | |
|---|---|
| Aqueous rosin emulsion | 10 parts |
| Aqueous acrylic resin emulsion | 60 parts |
| Aqueous ethylene-vinyl acetate copolymer emulsion | 15 parts |
| Aqueous Carbon Black dispersion | 14 parts |
| Fluorinated surfactant | 1 part |

COMPARATIVE EXAMPLE 2

A thermal transfer recording medium was prepared in a manner identical with that of Example 1, except that aqueous suspension (I) for forming the second heat softening layer was replaced with aqueous suspension (C-2) whose composition specified below for forming the second heat softening layer.

| Aqueous suspension (C-2) for second heat softening layer | |
|---|---|
| Aqueous paraffin wax emulsion | 20 parts |

-continued

| Aqueous suspension (C-2) for second heat softening layer | |
|---|---|
| Aqueous ethylene-vinyl acetate copolymer emulsion | 15 parts |
| Aqueous Carbon Black dispersion | 14 parts |
| Fluorinated surfactant | 1 part |

COMPARATIVE EXAMPLE 3

A thermal transfer recording medium was prepared in a manner identical with that of Example 1, except that aqueous suspension (I) for forming the second heat softening layer was replaced with aqueous suspension (C-3) whose composition specified below for forming the second heat softening layer.

| Aqueous suspension (C-3) for second heat softening layer | |
|---|---|
| Aqueous paraffin wax emulsion | 52 parts |
| Aqueous rosin emulsion | 10 parts |
| Aqueous acrylic resin emulsion | 8 parts |
| Aqueous ethylene-vinyl acetate copolymer emulsion | 15 parts |
| Aqueous Carbon Black dispersion | 14 parts |
| Fluorinated surfactant | 1 part |

COMPARATIVE EXAMPLE 4

A thermal transfer recording medium was prepared in a manner identical with that of Example 1, except that aqueous suspension (I) for forming the second heat softening layer was replaced with aqueous suspension (C-4) whose composition specified below for forming the second heat softening layer.

| Aqueous suspension (C-4) for second heat softening layer | |
|---|---|
| Aqueous paraffin wax emulsion | 20 parts |
| Aqueous rosin emulsion | 40 parts |
| Aqueous acrylic resin emulsion | 10 parts |
| Aqueous ethylene-vinyl acetate copolymer emulsion | 15 parts |
| Aqueous Carbon Black dispersion | 14 parts |
| Fluorinated surfactant | 1 part |

COMPARATIVE EXAMPLE 5

A thermal transfer recording medium was prepared in a manner identical with that of Example 1, except that aqueous suspension (I) for forming the second heat softening layer was replaced with aqueous suspension (C-5) whose composition specified below for forming the second heat softening layer.

| Aqueous suspension (C-5) for second heat softening layer | |
|---|---|
| Aqueous paraffin wax emulsion | 30 parts |
| Aqueous acrylic resin emulsion | 40 parts |
| Aqueous ethylene-vinyl acetate copolymer emulsion | 15 parts |
| Aqueous Carbon Black dispersion | 14 parts |
| Fluorinated surfactant | 1 part |

EVALUATION

The so-obtained thermal transfer recording media were independently loaded into a thermal printer (24 dot type; serial heads; pressure on platen, 180 g/head) and subjected to a recording (printing) operation with a rough paper having Bekk smoothness of 2" at a printing speed of 60 cps, thereby print quality was evaluated.

Next, the respective thermal transfer recording media were independently loaded into a high-speed thermal printer (24 dot type; serial heads; pressure on platen, 200 g/head) and subjected to a recording (printing) operation with a copy paper having Bekk smoothness of 20" at a printing speed of 120 cps, thereby print quality was evaluated.

The results obtained are listed in Tables 1a and 1b.

The symbols, in Tables 1a and 1b, representing evaluation criteria have the meanings below.

TABLE 1a

| | Rough paper, 60 cps | Copy sheet, 120 cps |
|---|---|---|
| Example 1 | Excellent | Excellent |
| Example 2 | Excellent | Excellent |
| Example 3 | Good | Excellent |
| Example 4 | Excellent | Excellent |
| Example 5 | Excellent | Excellent |
| Example 6 | Excellent | Excellent |
| Example 7 | Excellent | Excellent |
| Example 8 | Good | Good |
| Example 9 | Excellent | Excellent |
| Example 10 | Excellent | Good |
| Example 11 | Excellent | Excellent |
| Example 12 | Good | Excellent |
| Example 13 | Excellent | Good |
| Example 14 | Good | Good |

Print quality
Excellent Edge sharpness of the printed character "A" being satisfactory, and solid black area being free from voids.
Good Edge sharpness of a minor portion on the printed character "A" being not good, though solid black area being free from voids
Poor Edge sharpness of a minor portion on the printed character "A" being unsatisfactory, though solid black area being free from voids
Not good Edge sharpness of the printed character "A" being unsatisfactory and voids occurring in the solid black area TABLE 1b

| | Rough paper, 60 cps | Copy sheet, 120 cps |
|---|---|---|
| Comparative example 1 | Good | Not good |
| Comparative example 2 | Good | Poor |
| Comparative example 3 | Not good | Good |
| Comparative example 4 | Good | Not good |
| Comparative example 5 | Not good | Not good |

What is claimed is:

1. A thermal transfer recording medium comprising a support having thereon at least two heat softening layers in the order of a first heat softening layer and a second heat softening layer, wherein at least one of said first and second heat softening layers contains a colorant, and said second heat softening layer contains a heat fusible substance in an amount of from 15% to 50% by weight; a thermoplastic resin in an amount of from 20% to 80% by weight; and a tackifier in an amount of from 5% to 35% by weight;

said heat fusible substance being a vegetable wax, animal wax, petroleum wax, mineral wax, higher fatty acid, higher alcohol, amide, higher amine, or higher fatty acid ester, or a combination thereof;

said thermoplastic resin being a polyamide resin, polyester resin, polyurethane resin, polyolefin resin, acrylic resin, vinyl chloride resin, cellulose resin, ionomer resin, a diene copolymer, natural rubber, isoprene rubber, chloroprene rubber, phenol resin, cyclopentadiene resin, an aromatic hydrocarbon resin, or a mixture thereof; and, said tackifier being a rosin selected from the group consisting of an unmodified rosin, a hydrogenated rosin, a rosin maleic resin, a polymerized rosin, and rosin phenol resins; a terpene resin; or a petroleum resin.

2. The medium of claim 1, wherein said second heat softening layer contains said heat fusible substance in an amount of from 20% to 50% by weight; said thermoplastic resin in an amount of from 30% to 60% by weight; and said tackifier in an amount of from 10% to 30% by weight.

3. The medium of claim 1, wherein said second heat softening layer is a layer formed by applying an aqueous suspension.

4. The medium of claim 1, wherein said heat fusible substance and said thermoplastic resin are contained in a ratio of from 70:30 to 5:95, said heat fusible substance and said tackifier are contained in a ratio of from 90:10 to 40:60, and said thermoplastic resin and said tackifier are contained in a ratio of from 95:5 to 60:40.

5. The medium of claim 4, wherein said heat fusible substance and said thermoplastic resin are contained in a ratio of from 65:35 to 20:80, said heat fusible substance and said tackifier are contained in a ratio of from 85:15 to 45:55, and said thermoplastic resin and said tackifier are contained in a ratio of from 90:10 to 65:35.

6. The medium of claim 1, wherein a thickness of said second heat softening layer is within the range of from 0.3 μm to 2.5 μm, and the total thickness of said first and second heat softening layers is within the range of from 1.0 μm to 5.5 μm.

7. The medium of claim 1, wherein said thermoplastic resin is an acrylic resin.

8. The medium of claim 1, wherein said tackifier is said rosin.

9. The medium of claim 1, wherein said second heat softening layer contains a fluorinated surfactant.

10. The medium of claim 9, wherein said second heat softening layer contains said fluorinated surfactant in an amount of from 0.05% to 3% by weight.

11. The medium of claim 1, wherein said first heat softening layer contains not less than 50% by weight of a vegetable wax, animal wax, petroleum wax, mineral wax, higher fatty acid, higher alcohol, amide, higher amine or higher fatty acid ester, or a combination thereof and not more than 50% by weight of a polyamide resin, polyester resin, polyurethane resin, polyolefin resin, acrylic resin, vinyl chloride resin, cellulose resin, ionomer resin, a diene copolymer, natural rubber, styrene-butadiene rubber, isoprene rubber, chloroprene rubber, phenol resin, cyclopentadiene resin, an aromatic hydrocarbon resin, or a mixture thereof.

12. The medium of claim 11, wherein said first heat softening layer contains not less than 60% by weight of said heat fusible substance and not more than 30% by weight of said thermoplastic resin.

13. The medium of claim 11, wherein said first heat softening layer is a layer formed by applying an aqueous suspension.

14. The medium of claim 1, wherein said first heat softening layer is formed by applying a first aqueous suspension and said second heat-softening layer is formed by applying a second aqueous suspension; said second aqueous layer being applied in an amount whereby the dry thickness of the second softening layer is 0.3 to 2.5 μm; and the total dry thickness of said first and said second layer is 1.0 to 5.5 μm.

15. The medium of claim 14 wherein said second aqueous suspension comprises an aqueous paraffin wax emulsion, an aqueous rosin emulsion, an aqueous acrylic resin emulsion, an aqueous ethylene-vinyl acetate copolymer emulsion, a fluorinated surfactant and a pigment.

16. The medium of claim 14 wherein said tackifier is said rosin, terpene resin or petroleum resin having a parent nucleus containing 5 to 9 carbon atoms.

17. The medium of claim 16 wherein said thermoplastic resin is an acrylic resin, diene copolymer, polyolefin resin or a mixture thereof.

18. The medium of claim 1 wherein said tackifier is said rosin, terpene resin or petroleum resin having a parent nucleus containing 5 to 9 carbon atoms.

19. The medium of claim 18 wherein said thermoplastic resin is an acrylic resin, diene copolymer, polyolefin resin or a mixture thereof.

20. The medium of claim 1 wherein said thermoplastic resin is an acrylic resin, diene copolymer, polyolefin or a mixture thereof.

* * * * *